US005145161A

United States Patent [19]

Bowser et al.

[11] Patent Number: 5,145,161

[45] Date of Patent: Sep. 8, 1992

[54] SHEET FEEDER

[75] Inventors: David Bowser; Gerald D. Warden, both of Bethlehem, Pa.

[73] Assignee: Bell & Howell Phillipsburg Co., Sokie, Ill.

[21] Appl. No.: 518,440

[22] Filed: May 3, 1990

[51] Int. Cl.[5] ..... B65H 5/10

[52] U.S. Cl. ..... 271/12; 271/132; 271/134; 271/138; 271/124

[58] Field of Search ..... 271/11, 12, 99, 102, 271/104, 107, 121, 124, 125, 132, 134, 137, 138, 198

[56] References Cited

U.S. PATENT DOCUMENTS

| | | | |
|---|---|---|---|
| 2,635,874 | 4/1953 | LaBore | 271/125 |
| 2,815,207 | 12/1957 | Skow | 271/12 |
| 2,936,170 | 5/1960 | Herrick et al. | 271/12 |
| 2,977,114 | 3/1961 | Hanson et al. | 271/32 |
| 3,086,772 | 4/1963 | Vogel | 271/35 |
| 3,126,201 | 3/1964 | Rehm | 271/104 |
| 3,219,339 | 11/1965 | Gutierrez | 271/11 |
| 3,258,262 | 6/1966 | Rehm | 271/104 |
| 3,339,705 | 9/1967 | Burkhardt et al. | 198/34 |
| 3,844,551 | 10/1974 | Morrison | 271/99 |
| 3,871,642 | 3/1975 | Marianux et al. | 271/99 |
| 3,933,350 | 1/1976 | Mignano | 271/125 |
| 3,941,372 | 3/1976 | Matsuo | 271/104 |
| 3,960,373 | 6/1976 | Pacholok | 271/102 |
| 3,973,768 | 8/1976 | Shannon | 271/132 |
| 3,991,998 | 11/1976 | Banz et al. | 271/125 |
| 3,998,451 | 12/1976 | McInerny | 271/212 |
| 4,008,889 | 2/1977 | Ayres | 271/99 |
| 4,010,944 | 3/1977 | Young | 271/134 |
| 4,050,690 | 9/1977 | Michelson | 271/125 |
| 4,232,860 | 11/1980 | Brown | 271/125 |
| 4,284,270 | 8/1981 | Silverberg | 271/166 |
| 4,305,576 | 12/1981 | Hamlin | 271/11 |
| 4,359,214 | 11/1982 | Eldridge | 271/5 |
| 4,361,317 | 11/1982 | Lapp-Emden | 271/3.1 |
| 4,363,478 | 12/1982 | Tsukasaki | 271/134 |
| 4,478,400 | 10/1984 | Commers | 271/3.1 |
| 4,524,963 | 6/1985 | D'Angelo et al. | 271/3.1 |
| 4,546,963 | 10/1985 | Dinnissen | 271/125 |
| 4,548,395 | 10/1985 | Snellman et al. | 271/99 |
| 4,557,472 | 12/1985 | Hannon | 271/138 |
| 4,621,966 | 11/1986 | Luperti et al. | 414/43 |
| 4,657,236 | 4/1987 | Hirakawa et al. | 271/99 |
| 4,728,096 | 3/1988 | Winkler et al. | 271/134 |
| 4,746,007 | 5/1988 | Houseman | 198/470 |
| 4,799,664 | 1/1989 | Burger | 271/277 |
| 4,961,566 | 10/1990 | Labombarde | 271/124 |
| 4,991,831 | 2/1991 | Green | 271/125 |
| 5,013,024 | 5/1991 | Stevens | 271/171 |

FOREIGN PATENT DOCUMENTS

| | | | |
|---|---|---|---|
| 65798 | 3/1969 | German Democratic Rep. | 271/99 |
| 631421 | 11/1978 | U.S.S.R. | 271/134 |

*Primary Examiner*—Robert P. Olszewski
*Assistant Examiner*—Steven M. Reiss
*Attorney, Agent, or Firm*—Griffin, Branigan & Butler

[57] ABSTRACT

A Sheet Feeding System (10) having a reciprocating vacuum shuttle plate (52) includes a knife gate (112) and high-friction rollers 118 and 120 position between the knife gate and an additional conveyor formed by a driven feed roller 94 and an idler feed roller 96. The high-friction rollers form a singulator gap (188) with shoulders 184 of a vacuum-groove (186) on a sheet-engaging surface of the reciprocating shuttle plate. The sheet feeding system includes a transition tray (14) downstream of the additional conveyor for providing a transition to clamps of an endless chain (178). The transition tray comprises an endless conveyor belt (156) with a floating feed roller (160) biased thereagainst. The position of the floating feed roller can be adjusted so as to space it approximately a sheet length from a stationary clamp (176) on the endless chain. The shuttle plate comprises upper panels (76–90), one of which is a vacuum-groove panel (81) which can be interchanged with one another on a shuttle plate frame (74) so that the position of the vacuum-groove panel can be changed. A thumb mechanism 29 provides resistance to falling sheets so that a forward-most sheet (56) has reduced pressure on it.

15 Claims, 5 Drawing Sheets

SHEET FEEDER

BACKGROUND OF THE INVENTION

This invention relates broadly to Sheet Feeders, and more specifically to Sheet Feeders of a type for feeding individually, forward-most sheets, from a pile, usually to clamps of endless-chain conveyors.

It should be understood that "sheets" as used herein refer to envelopes as well as to individual sheets and other thin elements.

Reciprocating vacuum shuttle-plate sheet feeders are well known, with several being shown in U.S. Pat. Nos. 3,844,551 to Morrison and 4,657,236 to Hirakawa et al. A cycle of operation for these vacuum-type sheet feeding devices is normally approximately as follows: A suction is applied through a shuttle plate to a forward-most sheet in a sheet stack, thereby adhering the forward-most sheet to a sheet-engaging surface of the shuttle plate. The shuttle plate then moves in a feed direction carrying the forward-most sheet with it below a rigid blocking gate and delivers this to rollers, or additional conveyors, which then pull the sheet the rest of the way from the stack. At this point, the suction is turned off and the shuttle plate returns to its normal position at the sheet stack.

In some such systems, elongated knife gates, or other blocking structures, are used to restrain other sheets in the sheet stack from moving with the shuttle plate, while in some such systems the sheet stack rests on one or more ledges from which the bottom sheet is pulled prior to being fed forwardly by the shuttle plate. The sheet shuttle feed described in U.S. Pat. No. 3,844,551 to Morrison, combines both of these features. In this regard, one difficulty with some prior-art vacuum reciprocating-shuttle-plate sheet feeding devices is that suctions, or partial vacuums, applied by shuttle plates thereof, bleed through forward-most sheets and cause second-from-forward sheets to adhere to the forward-most sheets. When this happens, two sheets are sometimes fed forwardly by the shuttle plates. It is possible to reduce such "double feeds" by reducing the amount of suction applied to the forward-most sheets; however, such a method also reduces the strength with which the shuttle plate holds the forward-most sheet. This sometimes produces "miss feeds," that is, a shuttle stroke that feeds no sheet. By having redundant separators, U.S. Pat. No. 3,844,551 to Morrison allows a sufficiently high vacuum for substantially reducing "miss feeds" while preventing "double feeds" by pulling corners of forward-most sheets from a ledge with a separate suction cup just prior to their being fed. However, this redundancy has a price inasmuch as the structure required to move the separate suction cup is an added expense and its operation causes additional vibrations during overall operation of the sheet feeder. Thus, it is an object of this invention to provide a sheet feeder which reduces the number of "double feeds" and "miss feeds" but yet which does not require the use of a separate reciprocating sheet separator prior to or during movement of a vacuum shuttle plate.

There is a difficulty in positioning blocking structures in vacuum shuttle-plate sheet feeders employing such blocking structures, or gates, to prevent other sheets from following forward-most sheets. That is, if a blocking structure is positioned too high relative to its shuttle plate, it may allow a second-from-forward sheet to follow the forward-most sheet and if it is too low, it may improperly prevent a thick forward-most sheet from being fed. This problem is magnified when the sheet feeder is used for feeding envelopes. In this regard, it is difficult to separate a forward-most envelope with a throat knife, or other blocking structure, because loose envelope edges and windows tend to catch on the knife. For this reason, when feeding envelopes, it is desirable to have such a blocking structure, or throat knife, in a relatively open position. On the other hand, when such a throat knife is too "open" a double will occur. It is an object of this invention to provide a vacuum shuttle-plate sheet feeder in which a throat knife can be placed in a relatively "open" position so that it can be easily used with envelopes but yet which does not produce an undue number of "double feeds".

Yet another difficulty with reciprocating vacuum shuttle plate sheet feeders has been that shuttle plates thereof applied suction at fixed locations on forward-most sheets. For example, in a device of U.S. Pat. No. 3,844,551, a suction groove of a shuttle plate thereof is in one position relative to the shuttle plate and a hopper and cannot be moved. A difficulty with such a structure is that a position of its suction groove cannot be tailored to fit different size and shaped envelopes. Thus, the vacuum groove may damage envelope windows if its necessary position happens to coincide with envelope windows, for example. Also, suction-groove positioning may detrimentally affect the accuracy of sheet feeds because when a sheet is pulled too close to an edge thereof it often skews and jams, especially when there is a heavy stack of paper thereon. Ideally, a suction groove should be arranged to pull a sheet at a position as close to the center thereof as possible. It is therefore, an object of this invention to provide a vacuum shuttle plate sheet feeder in which the position at which vacuum is applied relative to a hopper and a shuttle plate can be varied so that the shuttle plate can be tailored to fit various size and shaped envelopes.

Many previous vacuum shuttle sheet feeders feed envelopes directly to indexed, or momentarily stationary, clamps mounted on endless chain conveyors. Any slippage in conveying such envelopes from bottoms, or forward-most positions, of their stacks to the gripper jaws of such clamps causes an imprecise placement of the envelopes in the jaws which often causes jams or improper feeds downstream thereof. For example, if an envelope is crammed too firmly into a gripper jaw of a clamp, a leading edge of the envelope will be bent, thereby causing problems for later handling of the envelope. On the other hand, if the envelope is not fed far enough into a clamp's gripper jaw, the envelope might be inadequately held when the gripper jaw closes, again causing problems downstream. Thus, it is an object of this invention, to provide a transition structure between a sheet feeder and a gripper jaw of an endless conveyor mounted clamp such that a sheet is fed precisely into the gripper jaw thereof.

Yet another difficulty with many sheet feeders is that stacks placed in hoppers thereof cause great weight forces pressing downwardly on bottom, or forward-most, sheets therein, making it difficult for shuttle plates and the like to pull these forward-most sheets from the stacks. It is an object of this invention to counteract this downward gravity force acting on forward-most sheets to thereby make it easier for shuttle plates, and similar separating elements, to pull forward-most sheets from stacks.

SUMMARY OF THE INVENTION

According to principles of this invention, a reciprocating vacuum shuttle-plate sheet feeder employs a friction-type singulator between a throat knife gate and a downstream additional conveyor. The friction-type singulator comprises two resilient fixed rollers which form gaps with shoulders positioned on opposite sides of a vacuum grove of a vacuum shuttle plate. Gaps formed by the knife gate and the high-friction rollers with the shuttle plate can be adjusted together or independently.

The shuttle plate itself comprises an underlying vacuum manifold and interchangeable top-surface plates, one of which has vacuum openings therein. Thus, by interchanging these panels, the positions of the vacuum openings in the shuttle plate can be changed while still keeping these openings in communication with the vacuum manifold and not changing the position and/or size of the shuttle plate.

The sheet feeder of this invention includes a feed tray for inserting fed sheets into a gripper jaw of a clamp mounted on an endless conveyor, ensuring that sheets fed from a sheet stack by the shuttle plate are properly inserted into the gripper jaw. The feed tray comprises a continuously driven endless conveyor belt against which a floating feed roller is biased. The position of the floating feed roller along the belt can be varied so that it can be placed approximately the length of a sheet from a stopped clamp on the endless conveyor. Sheets fed to the feed tray by the shuttle plate are further conveyed by the endless conveyor and the floating feed roller firmly and accurately into the gripper jaw of the clamp.

Guides of a hopper of the sheet feeder include a thumb mechanism which provides resistance to falling sheets so that a forward-most sheet does not have a great deal of pressure on it.

BRIEF DESCRIPTION OF THE DRAWINGS

The forgoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
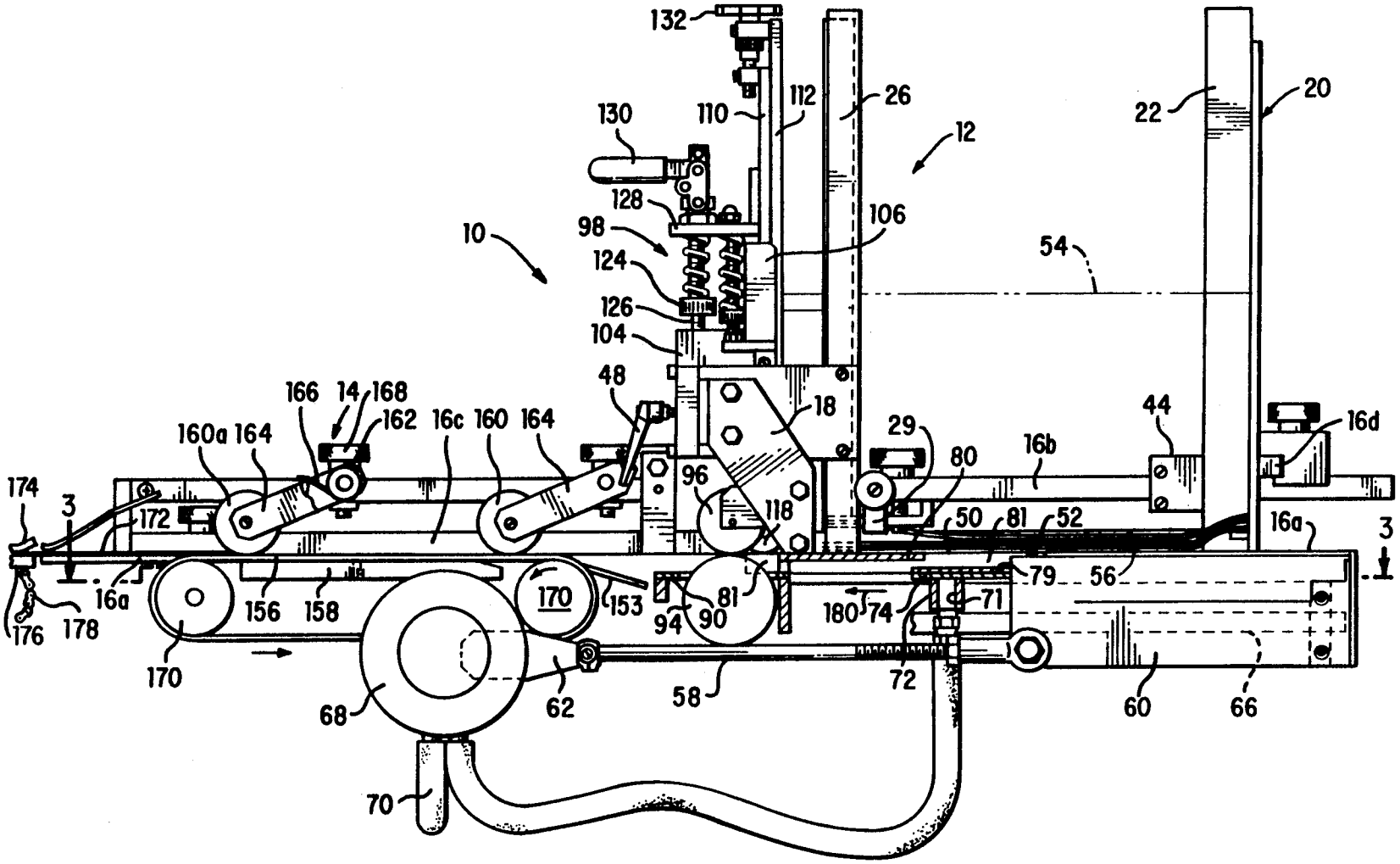
FIG. 1 is a simplified, side, partially sectional, view of a sheet feeder system of this invention.

A sheet feeding system 10 includes generally a vacuum reciprocating shuttle sheet feeder 12, and a sheet feeding transition tray 14.

The entire system has support structures 16 which are rigidly attached together and supported from a floor (not shown). Included in the support structure 16 are horizontal surfaces **16*a*, a rear mounting bar 16*b*, feed path guides 16*c*, a hopper transverse support bar 16*d*, a separator transverse support bar 16*e*, etc. It will be understood that there are other support structures, such as bracket 18 for supporting the separator mechanism transverse support bar 16*e* from the horizontal surface 16*a* and a bracket 19 for supporting the hopper transverse support bar 16*d* from the horizontal surface 16*a***, which are not further described but yet which can be seen in the drawings.

The vacuum reciprocating shuttle sheet feeder 12 includes a hopper 20 which is defined by rear hopper guides 22 and 24 and front hopper guides 26 and 28. Each of the rear hopper guides 22 and 24 respectively includes a pile lifter 30 and 32 and one of the front hopper guides 26 and 28 includes a thumb mechanism 29. The purpose of the rear pile lifters 30 and 32 is to lift rear corners of sheets 36 held in the hopper 20 to compensate for warped sheets and to provide better contact for a forward-most sheet 56 to a vacuum groove 186 described below. It can be seen in FIG. 2 that the rear hopper guides 22 and 24 can be laterally adjusted along the hopper transverse support bar **16*d* by means of clamps 38 and that the hopper transverse support bar 16*d*, in turn, can be adjusted along the rear mounting bar 16*b* and along a slot 40 in the horizontal surface 16*a* by means of clamps 42 and 44. The front hopper guides 26 and 28 have similar lateral adjustments, with the front hopper guide 26 being adjustable along the separator mechanism transverse support bar 16*e* by means of a clamp 46 which is fastened to the separator mechanism transverse support bar 16*e* by means of a set screw operated by a lever 48. Guides 34 and 36** help support the sheets.

Figure 7:
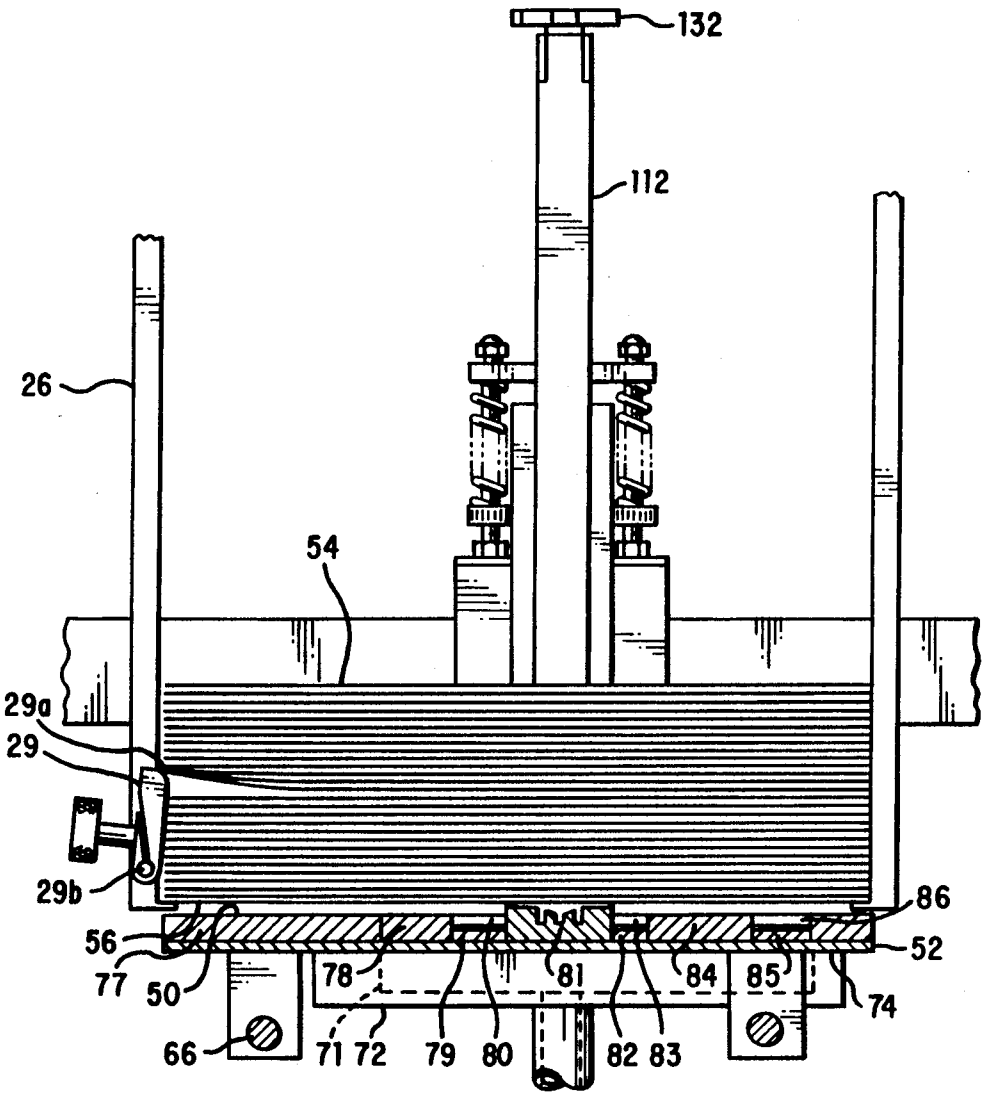
FIG. 7 is a segmented, simplified, partially in cross section, view schematically showing operation of a thumb mechanism of this invention.

It should be noted that the thumb mechanism 29, shown in FIG. 7, is positioned about an inch above a top surface 50 of a reciprocating shuttle plate 52 about one and one half inches from a front corner of a sheet stack 54. Positioned in this manner, this thumb mechanism 29 supports a forward front edge of the sheet, or envelope, stack 54, shown in phantom in FIG. 1, above a forward-most sheet 56 by pressing against a side thereof, but yet allows the forward-most sheet 56 and several sheets above the forward-most sheet to fall completely down on the top surface 50 of the shuttle plate. The purpose of the thumb mechanism 29 is to lift and separate sheets in a manner analogous to a person "thumbing" through a stack of paper, thus, removing weight from the forward-most sheet 56. The thumb mechanism 29 has a convex rounded surface **29*a*, much in the shape of a person's thumb. It is made of metal in a preferred embodiment and can be clamped to a shaft 29*b* to be placed at any angle into the sheet stack 54**.

Figure 2:
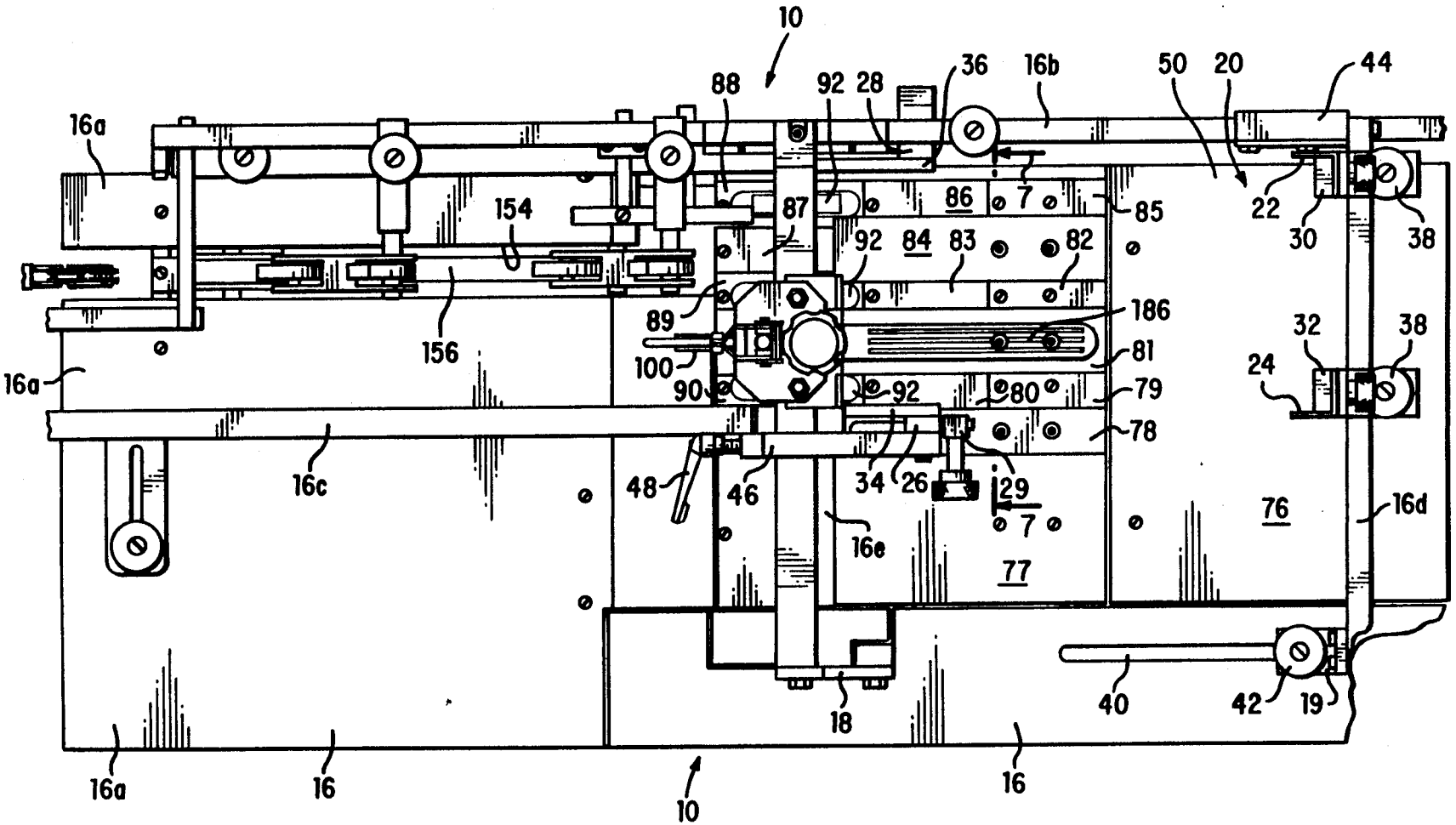
FIG. 2 is a top view of the structure of FIG. 1.
Figure 3:
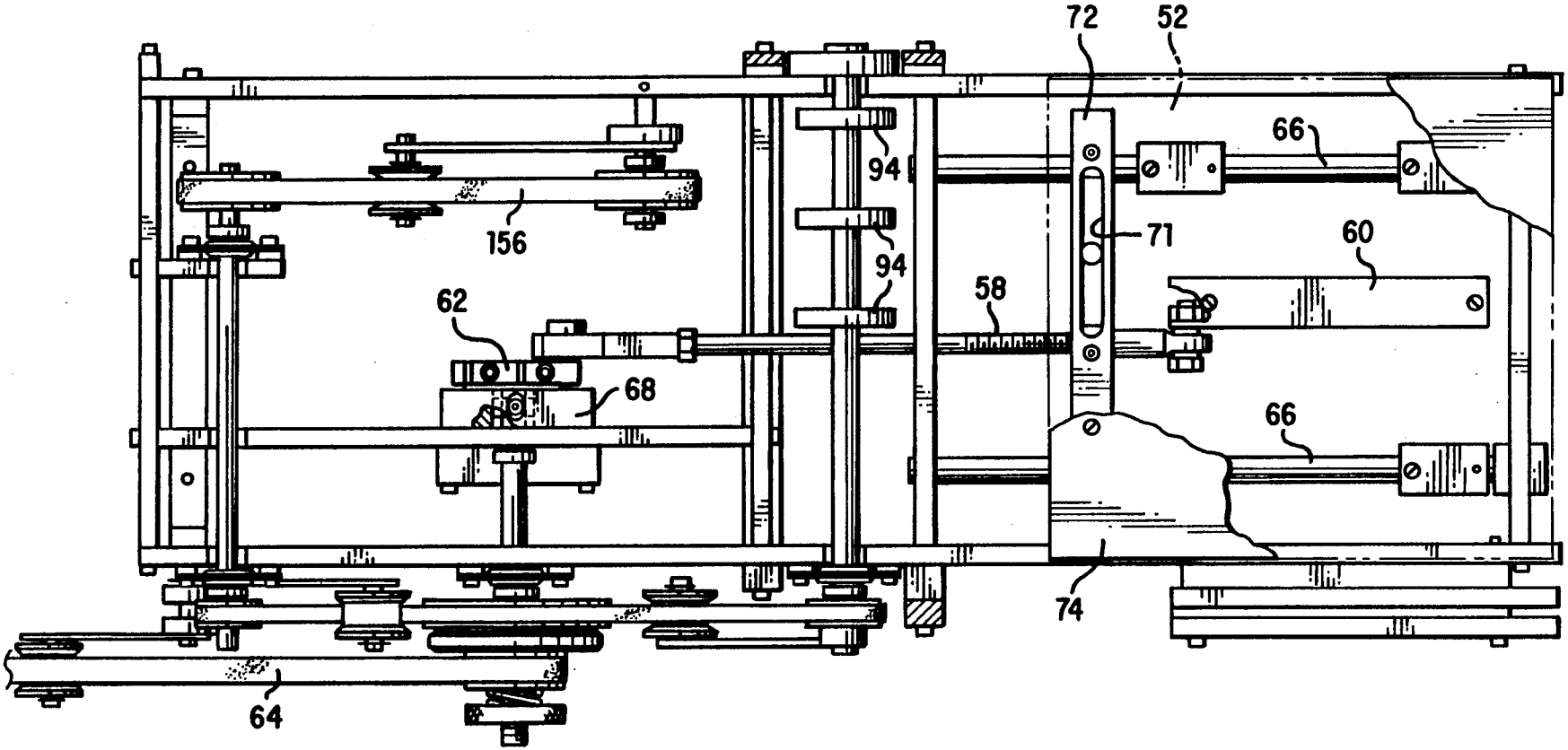
FIG. 3 is a top view taken approximately on line 3—3 in FIG. 1, with many parts being removed for simplification, showing the substructure of the sheet feeder system of FIGS. 1 and 2.

The shuttle plate 52, as depicted in FIGS. 1–3 is in its rear most position, to the right. The shuttle plate is reciprocated between this rear-most position and a forwardly-most position (to the left as depicted in FIGS. 1–3) by a shuttle plate drive shaft 58 which is coupled between a shuttle plate bracket 60 and a rotatable clamp 62. As a drive belt 64 drives the rotatable clamp 62, the shuttle-plate drive shaft 58 is moved from right to left, and back to right, thereby reciprocating the shuttle plate 52 to which the shuttle-plate bracket 60 is attached. The shuttle plate reciprocally rides on shuttle-plate guide shafts 66 which are part of the supporting structure.

Similarly, as the drive belt 64 drives the rotatable clamp 62, it also operates a valve 68 which controls vacuum from an inlet line 70 to a cavity 71 of a shuttle-plate vacuum manifold 72. In this regard, the manifold 72 is bolted to an underside of a shuttle-plate base 74 to which are bolted, on an upper side thereof, shuttle-plate upper panels 76, 78, 79, 81, 82, 84 and 85. It should be noted that the shuttle-plate upper panels are of various sizes in the depicted embodiment as a matter of convenience, however, where appropriate, they could be of equal size. A primary reason for these removable upper panels is to allow a vacuum-groove panel 81 to be moved laterally, that is, upwardly and downwardly as viewed in FIG. 2. When the vacuum-groove panel 81 is moved laterally, it remains in communication with the manifold cavity 71 through holes in the shuttle-plate base 74, while other panels which are placed over the manifold cavity 71 do not allow transmission of a vacuum therethrough. It will be appreciated that the shuttle-plate base 74 also has an opening or openings therethrough corresponding to the manifold 72. Support-structure upper panels 88, 89, and 90 are special plates, each of these having an oblong opening 92 therein to allow a driven feed roller 94 to come into contact with an idler feed roller 96, forming a nip therebetween which is basically an additional conveyor for gripping a forward-most sheet 56 when it is separated by vacuum applied to the shuttle plate 52 and thereby pulled from under the stack 54, as will be described below. Support-structure panels 80, 83, 86, 87, 88, 89 and 90 serve mainly as guards to protect persons from being pinched by moving mechanisms and to support sheets. Clamp 46 also serves as a guard. It can be noted in FIG. 1 that the support-structure panels 80, 83 and 86 are at a higher level than the shuttle-plate panels 79, 82 and 85 so that these shuttle-plate panels can slide thereunder. It can be seen in FIG. 7 that the vacuum groove panel 81 is taller than adjacent panels which enhances its vacuum seal with the forward-most sheet 56.

The reciprocating vacuum shuttle sheet feeder 12 also includes a sheet separator 98 which is mounted on the separator mechanism transverse support bar 16*e* by means of a set screw operated manually by a lever 100. A main frame 102 of the sheet separator 98 includes a block 104 and a channel member 106. Riding in a channel 108 of the channel member 106 are a friction singulator roller support bar 110 and a knife gate 112. Each of these members is slideably moveable in the channel 108, but is held in the channel by means of screws 114 embedded in the channel member 106 which pass through slots in the singulator roller support bar 110 and the knife gate 112. High-friction rollers 118 and 120 are mounted on a downstream, or front, side of the singulator roller support bar 110 by means of a hub 122 and their positions relative to the block 104 can be adjusted by means of a knob 124 which screws a screw 126 into and out of the block 104 to thereby move a bracket 128 which is positioned on an extension of the screw 126. In this regard, a toggle clamp 130, which is attached to and rotates on bracket 128 includes threads to engage threads of the extension of the screw 126. These threads are the same hand but of different pitch than those of block 104, or they can be of opposite hand, to effect a relative motion between block 104 and the bracket 128 when the knob 124 is rotated. In any event, the toggle clamp 130 can be used to quickly raise the singulator roller support bar 110, the knife gate 112, and idler feed rollers 96 by allowing the bracket 128 to quickly be forced upwardly on the extension of the screw 126 by means of a compression spring 131 mounted on the extension of the screw 126. During normal operation, the toggle clamp 130 is rotated downwardly, as shown in FIG. 5, so that the bracket 128 is locked in a fixed position, relatively close to the block 104.

The high-friction rollers 118 and 120, under normal operation do not roll, but rather are in fixed positions. However, they can be loosened and rolled, or rotated, to new positions so as to present fresh wear surfaces to sheets, thereby adjusting for wear. The high-friction rollers 118 and 120 are constructed of a material having a coefficient of friction such that when the high-friction rollers 118 and 120 impinge on a top sheet, such as an envelope, of a sheet pair double passing thereunder a friction force between the high-friction rollers 118 and 120 and the top sheet is greater than the friction force between the top sheet and a bottom sheet of the pair so that the top sheet is stripped from the bottom sheet, with the bottom sheet being transported further and the top sheet being held by the high-friction rollers 118 and 120. In a present embodiment a seventy durometer urethane is employed.

The knife gate 112 can also be moved relative to the singulator roller support bar 110 by means of a knob 132 journaled for rotation in a bracket 134 attached to the knife gate 112 for rotating a screw 136 having male threads which mate with female threads in a bracket 138 attached to the singulator roller support bar 110. When the knob 132 is rotated, the threads of the screw 136 cooperate with the internal threads of the bracket 138 to cause the knife gate 112 to move longitudinally relative to the singulator roller support bar 110.

Figure 6:
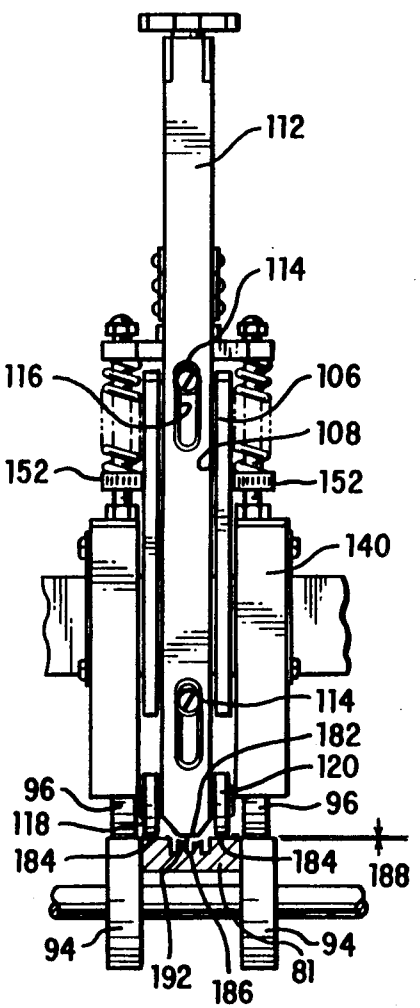
FIG. 6 is a rear elevational view of the structure of FIG. 5, as seen from a sheet stack.
Figure 5:
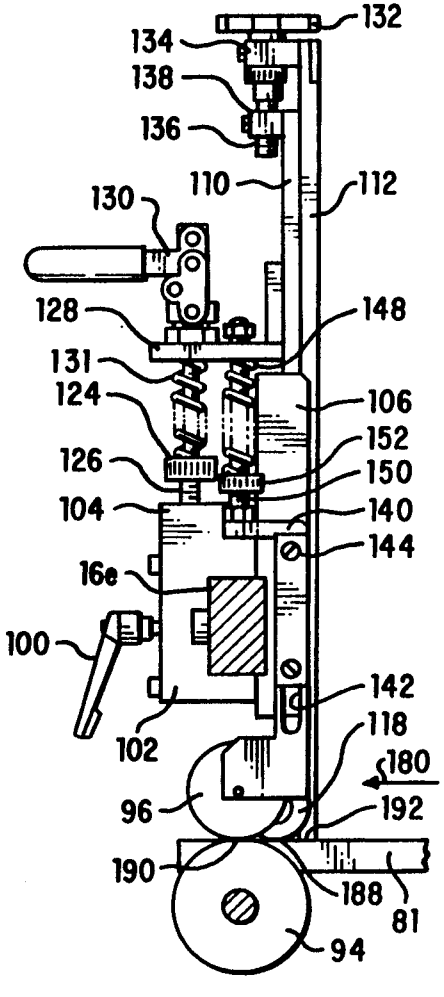
FIG. 5 is a side elevational view of the structure of FIG. 4, but also including a driven feed roller and showing a portion of a shuttle plate.
Figure 4:
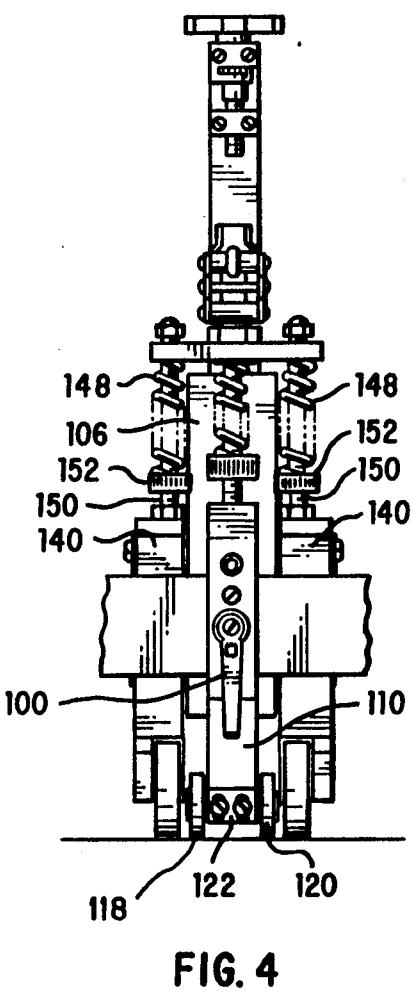
FIG. 4 is a fragmented elevational front view of a sheet separator mechanism of the system of FIGS. 1 and 2.

Mounted on outer side surfaces of the channel member 106 are idler-feed-roller followers 140 which are free to move longitudinal, upwardly and downwardly as viewed in FIGS. 4–6, because slots 142 therein allow such movement on mounting bolts 144. The idler-feed-roller followers 140 are biased downwardly by means of compression springs 148 positioned on extensions of screws 150 having threads which mesh with females threads of the idler-feed-roller followers 140. By rotating knobs 152 of the screws 150, tension of the springs 148 can be adjusted for varying pressures with which the idler-feed-rollers 96 are urged downwardly against the driven feed rollers 94. In this regard, the idler-feed-rollers 96 are mounted on the lower end of the idler-feed-roller followers 140.

Describing next the sheet-feeding transition tray 14 (FIG. 1), this tray comprises a horizontal surface 16*a*, having a ramp 153, which is part of the support structure 16 but which defines a slot 154 (FIG. 2) therein in which is positioned a continuously running conveyor belt 156 supported by a fixed plate 158. The sheet-feeding transition tray 14 also comprises floating feed rollers 160 which are mounted on the rear mounting bar 16*b* by means of clamps 162 and which are biased on levers 164 by means of springs 166 toward the conveyor belt 156. In this regard, by rotating knobs 168 of the clamps 162 and moving the clamps 162 along the rear mounting bar 16*b*, the positions of the floating feed rollers 160 along the conveyor belt 156 can be changed. The conveyor belt 156 is continually driven by pulleys 170 which, in turn, are driven by the drive belt 64 as can be seen in FIG. 3. When a sheet enters bites between the floating feed rollers 160 and the conveyor belt 156, it is automatically moved to the left as viewed in FIG. 1.

This entire structure is positioned so that a sheet 172 (FIG. 1) exiting from the sheet-feeding transition tray 14 will be fed exactly into a jaw 174 of a clamp 176 mounted on an endless conveyor chain 178.

Describing next operation of the sheet feeding system of this invention, an operator first determines the best location of the vacuum groove panel 81 above the manifold 72. To do this, he observes the size of sheets to be fed and the location of objects on the sheet. For example, if the sheet is an envelope with a window, he will want to place the shuttle vacuum-groove panel 81 in a location such that it will not suck on, and perhaps deform, such a window. He does this by screwing particular shuttle-plate and support-structure panels 76–90 off and then remounting them with the shuttle vacuum-groove panel 81 in an appropriate position above the cavity 71 of the vacuum manifold 72.

Also, the operator adjusts positions of the rear and front hopper guides 22, 24, 26 and 28 so that they appropriately guide the edges of a sheet stack to be placed therein. The rear hopper guides 22 and 24 are adjusted laterally on the hopper transverse support bar **16*d*, and in the direction of sheet travel by sliding the hopper transverse support bar 16*d* along the rear mounting bar 16*b* and in the slot 40 of the support structure 16. Similarly, the clamp 46 is moved along the separator mechanism transverse support bar 16*e* to laterally adjust the front hopper guide 26. There is a similar adjustment for the front hopper guide 28**.

In addition, the positions of the floating feed rollers 160 on the sheet feeding transition tray 14 are adjusted in the direction of sheet travel. In this regard, it is desirable that a last floating feed roller **160*a* be spaced from the jaw 174 of a momentarily-stationary clamp 176 mounted on the endless conveyor chain 178 a distance approximately equal to the length of a sheet 172 so that this sheet 172 will lose engagement with the last floating feed roller 160 when it is inserted into the jaw 174. With such an arrangement, a leading edge of the sheet 172 will not be crammed too strongly into the jaw 174 and thereby distorted, nor will it not be shoved far enough into the jaw 174** and thereby cause problems downstream.

The next adjustment that must be made is to the sheet separator 98 so that the separator separates only a forward-most sheet 56 from the sheet stack 54 when the shuttle plate 52 is reciprocated in the sheet separating direction 180. First the lateral position of the sheet separator 98 is adjusted along the separator mechanism transverse support bar **16*e*, utilizing the set screw lever 100, so that the knife gate 112 is lined up with a vacuum groove 186 of the vacuum-groove panel 81. Next, the friction singulator roller support bar 110 and the knife gate 112 are set to their appropriate vertical positions. These vertical adjustments are carried out by first closing the toggle clamp 130, that is, rotating it downwardly as shown in FIG. 1, to thereby snap the bracket 128, the friction singulator roller support bar 110, and the knife gate 112 downwardly. The knife gate 112 is moved out of the way of rotating the knob 132 so that a separating lower end 182 thereof does not obstruct movement of forward-most sheets in the sheet separating direction 180. A single sheet of the type to be separated is laid in the hopper 20 and slid under the separating lower end 182 of the knife gate 112 until it contacts the high-friction rollers 120. If it does not contact these, these are lowered by rotating the knob 124 on the sheet separator 98 to thereby move the screw 126, the bracket 128, and the friction singulator roller support bar 110 downwardly until such contact is made. The high-friction rollers 118 and 120 are spaced above shoulders 184 of the shuttle vacuum-groove panel 81 on opposite sides of a vacuum groove 186 thereof, such that one sheet can pass between a singulator gap 188 formed therebetween. Once the high-friction rollers 118 and 120 are in an appropriate position to form an appropriate singulator gap 188 with the shoulders 184 on opposite sides of the vacuum groove 186 for allowing only a single sheet to pass thereunder, the knife gate 112 is adjusted downwardly by rotating the knob 132, thereby moving the knife gate 112 downwardly relative to the friction singulator roller support bar 110. The separator lower end 182 of the knife gate 112 is adjusted so that it is barely in position to block a single sheet trying to pass thereunder without any vacuum applied to the vacuum groove 186 of the shuttle vacuum-groove panel 81. In this position, the knife gate 112 will block movement of second-from forward sheets in the sheet separating direction 180, but the forward-most sheet 56 will be pulled downwardly by vacuum applied in the vacuum groove 186 so that it can clear the separating lower end 182 of the knife gate 112 to move in the sheet separating direction 180. The second-from-forward sheet, immediately above the forward-most sheet, will not have a significant vacuum applied to it and therefore will not be lowered below the separating lower end 182 of the knife gate 112 and, therefore, cannot follow the forward-most sheet in the sheet separating direction 180. The space relationships in the sheet separating direction 180 of a feed nip 190 formed between the driven feed rollers 94 and the idler feed rollers 96 and the singulator gap 188 formed between the high-friction rollers 118 and 120 and the shoulders 184 on opposite sides of the vacuum groove 186 relative to a throat 192 formed between separator lower end 182 at the knife gate 112 and the vacuum groove 186 should be noted. The throat 192 is upstream of the singulator gap 188 which, in turn, is upstream of the feed nip 190**.

The idler feed roller 96, the high-friction rollers 118 and 120, and the separating lower end 182 of the knife gate 112 can be quickly raised relative to the shuttle-vacuum groove panel 81, when necessary, without changing their relative relationships one to the other by raising the toggle clamp 130.

Adjustments now being substantially completed, operation of the sheet feeding system 10 will now be described.

A stack 54 of sheets is placed in the hopper 20 and the sheet feeding system is turned on. The drive belt 64 rotates the rotatable clamp 62 to reciprocate the shuttle plate 52. Simultaneously, the drive belt 64 operates the valve 68 to apply a vacuum to the vacuum groove 186 every time the shuttle plate 52 is approaching its right-most position as shown in FIG. 1, and to relieve the vacuum when the shuttle plate 52 is in a position for feeding a forward-most sheet into a feed nip 190. It appears that there is some advantage to turning the vacuum on prior to the shuttle plate 52 reaching its right-most position and drawing a forward-most sheet slightly to the right before feeding it in a sheet separating direction 180 to the left. Simultaneously therewith, the drive belt 64 continuously drives the conveyor belt 156 of the sheet feeding transition tray 14. When a vacuum is applied to the vacuum groove 186, the forward-most sheet 56 is pulled slightly downwardly into the throat 192 immediately below the separating lower end 182 of the knife gate 112 and this forward-most sheet is, therefore, allowed to pass under the knife gate 112 with movement in the separating direction 180 of the shuttle plate 52. Should, however, sheets immediately above the forward-most sheet also pass through the throat 192, these sheets will frictionally contact the high-friction rollers 118 and 120, and will thereby not be allowed to pass through the singulator gap 188 formed between these high-friction rollers and the shoulders 184 formed on the shuttle vacuum-groove panel 81 on opposite sides of the vacuum groove 186. With further movement of the shuttle plate in the sheet separating direction 180, the forward-most sheet will eventually pass into the feed nip 190 of the driven and idler feed rollers 94 and 96 at which point the vacuum in the vacuum groove 186 will be turned off. Since the driven feed roller 94 is also continuously driven by the drive belt 64, this nip will further transport the forward-most sheet pulling it the rest of the way from the under the stack 54 and leaving all sheets thereabove still in the stack.

This forward-most sheet will thereby be fed onto the horizontal surface 16*a* by a ramp 153 thereof and between nips formed by the floating feed rollers 160 and the conveyor belt 156. This Ramp 153 is part of guard configuration to prevent pinch points and support sheets. The continuously driven conveyor belt 156 will thereby pick up the forward-most sheet and transport it into an open jaw 174 of a temporarily stationary chain mounted clamp 176 at which point the sheet will be freed from a last transporting nip between the floating feed roller 160*a* and the conveyor belt 156.

The tremendous advantages of the sheet-feeding system 10 of this invention will be immediately understood by those of ordinary skill in the art. By being able to change the position of the vacuum groove 186 on the shuttle plate 152, an operator can place the vacuum groove so that it will not damage, or improperly engage, sensitive portions of a sheet, such as an envelope. In this manner, the vacuum groove can also be moved to a position at which it will be most effective on a sheet.

Also, the thumb mechanism 29, which provides support for an edge of some sheets in the sheet stack 54 above the forward-most sheet 56, relieves some downward weight pressure on the forward-most sheet 56, but is not sufficiently large, or shaped, to prevent sheets in the sheet stack 54 from falling downwardly and thereby eventually becoming forward-most sheets themselves.

Also, the placing of the knife gate throat, the friction singulator gap, and the additional conveyor respectively downstream from one another in a series, provides a high degree of separation accuracy during each shuttle plate stroke but yet does not require extra mechanical movement of parts and is therefore inexpensive in construction and setup, and is smooth in operation. It has been found that this arrangement is extremely accurate, virtually eliminating all doubles.

Yet another benefit derived from the sheet-feeding system 10 is that it feeds sheets into jaws of conveyor-mounting clamps accurately, without cramming the sheets into the clamps thereby deforming leading edges of the sheets, but yet ensures that the sheets are sufficiently inserted into the jaws.

It is beneficial to have the shoulders 184 of the vacuum panel raised above adjacent shuttle-plate panels to provide a better seal between them and the forward-most sheet 56.

While the invention has been particularly shown and described with reference to a preferred embodiment, it will be understood by those skilled in the art that various changes in form and detail may be made therein without departing from the spirit and scope of the invention. For example, it is possible to adjust the position of a vacuum slot or opening relative to sheets to be fed by shifting an entire shuttle plate relative to a feeder or an entire feeder relative to a shuttle-plate.

The embodiments of the invention in which an exclusive property or privilege are claimed or defined as follows:

1. A sheet feeding device for feeding a forward-most sheet from a stack of flat sheets, said device comprising:

a hopper for holding said stack of sheets;

a movable shuttle means having a sheet-engaging surface on which said stack rests for gripping said forward-most sheet and pulling said forward-most sheet out of the sheet stack, said movable shuttle means having a motion in a separating direction substantially parallel to a plane of said flat sheets, said movable shuttle means defining a vacuum opening therethrough to said sheet-engaging surface;

a suction means for synchronously applying suction to said sheet-engaging surface through said vacuum opening for gripping said forward-most sheet to said sheet-engaging surface so that the shuttle means carries said forward-most sheet with it when it moves in said separating direction to deliver said forward-most sheet to an additional conveyor;

said additional conveyor being positioned downstream from said stack of flat sheets in said sheet-separating direction for receiving said forward-most sheet from said shuttle means and further pulling said sheet from said stack;

a first blocking means positioned adjacent said stack of said flat sheets and being spaced adjacent a path of said shuttle means in said separating direction downstream of said stack of flat sheets but upstream of said additional conveyor for contacting non-fed sheets in said stack other than said forward-most sheet and thereby preventing said non-fed sheets from following said forward-most sheet when it is fed in said separating direction;

a second blocking means positioned in said separating direction downstream of said first blocking means but upstream of said additional conveyor for contacting a double sheet, that is a sheet other than said forward-most sheet carried by said shuttle means in said separating direction, thereby preventing said double sheet from being fed to said additional conveyor;

whereby the shuttle means carries said forward-most sheet past the first and second blocking means to said additional conveyor, but a double sheet following said shuttle means past said first blocking member is stripped from said forward-most sheet and not allowed to follow said forward-most sheet to said additional conveyor by said second blocking means;

wherein said first blocking means is an elongated knife gate and said shuttle means is a reciprocating shuttle plate including a vacuum groove which is positioned immediately below a separating lower end of said elongated knife gate and wherein said second blocking means comprises two singulator separators positioned on opposite sides of said vacuum groove, for forming singulator gaps between them and shoulders formed on said shuttle plate on opposite sides of said vacuum groove.

2. A sheet feeding system as in claim 1 wherein said shuttle means includes a vacuum panel at said vacuum opening having surfaces above adjacent surfaces for contacting said forward-most sheet.

3. A sheet feeding system as in claim 1 wherein said system includes a sheet separator mechanism allowing independent adjustment of said singulator separators and said knife gate so that the position of said separating lower end of said knife gate in said vacuum groove and the size of said singulator gaps can be adjusted independently of one another.

4. A sheet feeding system as in claim 3 wherein said singulator separators comprise high friction non-rotating rollers.

5. A sheet forming system as in claim 1 wherein said singulator separators comprise high friction non-rotating rollers.

6. A sheet feeding system as in claim 1 wherein that portion of said shuttle plate forming said vacuum groove forms flat shoulders on opposite sides of said vacuum groove and wherein said singulator separators form two singulator gaps with said shoulders on opposite sides of said vacuum groove.

7. A sheet feeding system as in claim 1 wherein said second blocking means comprises high friction singulator material.

8. A sheet feeding system as in claim 1 wherein is further included an endless clamp conveyor having clamps thereon for receiving sheets from said additional conveyor, said sheet-feeding system further comprising a sheet feeding transition tray having a continuously driven endless belt conveyor forming a nip with an idler roller which is biased toward said endless belt conveyor for conveying sheets received from said additional conveyor to said clamps positioned on said endless clamp conveyor, said sheet feeding transition tray including an idler-roller mounting means for allowing the position of said idler roller to be adjusted along the endless belt so that the position of said idler roller can be placed approximately a distance from a clamp receiving a sheet equal to the length of the sheet.

9. A sheet feeding system as in claim 1 wherein is further included an adjusting means for allowing the position of said vacuum opening relative to said sheet stack in said hopper to be changed in a direction perpendicular to said separating direction approximately parallel to a plane of said forward-most sheet.

10. A sheet feeding system as in claim 9 wherein said shuttle means is a reciprocating shuttle plate said adjusting means includes interchangeable panels on said shuttle plate one of which is a vacuum-opening forming panel to allow the position of said vacuum-opening forming panel to be moved between a plurality of different positions on said shuttle plate, said shuttle plate further including a manifold having an enlarged manifold cavity located below a plurality of said interchangeable panels, whereby said vacuum-opening forming panel can receive vacuum from said manifold cavity located at said plurality of different positions on said shuttle plate.

11. A sheet feeding system as in claim 1 wherein the spacing between separating lower ends of said first and second blocking means relative to travel of said shuttle means can be adjusted independently of one another.

12. A sheet feeding system as in claim 1 wherein said system further includes a hopper with edge guides for engaging edges of sheets in said stack of flat sheets, said hopper further including a thumb mechanism thereon for engaging a front edge of sheets in said stack located above said forward-most sheet, to provide a lift for said sheets above said forward-most sheet, while allowing said sheets above said forward-most sheet to move toward said forward-most sheet under an applied force.

13. A sheet feeding device for feeding a forward-most sheet from a stack of flat sheets, said device comprising:

a hopper for holding said stack of sheets;

a movable shuttle means having a sheet-engaging surface on which said stack rests for gripping said forward-most sheet and pulling said forward-sheet out of the sheet stack, said movable shuttle means having a motion in a separating direction substantially parallel to a plane of said flat sheets, said movable shuttle means defining a vacuum opening therethrough to said sheet-engaging surface;

a suction means for synchronously applying suction to said sheet-engaging surface through said vacuum opening for gripping said forward-most sheet to said sheet-engaging surface so that the shuttle means carries said forward-most sheet with it when it moves in said separating direction to deliver said forward-most sheet to an additional conveyor;

said additional conveyor being positioned downstream from said stack of flat sheets in said sheet-separating direction for receiving said forward-most sheet from said shuttle means and further pulling said sheet from said stack;

a first blocking means positioned adjacent said stack of said flat sheets and being spaced adjacent a path of said shuttle means in said separating direction downstream of said stack of flat sheets but upstream of said additional conveyor for contacting non-fed sheets in said stack other than said forward-most sheet and thereby preventing said non-fed sheets from following said forward-most sheet when it is fed in said separating direction;

a second blocking means positioned in said separating direction downstream of said first blocking means but upstream of said additional conveyor for contacting a double sheet, that is a sheet other than said forward-most sheet carried by said shuttle means in said separating direction, thereby preventing said double sheet from being fed to said additional conveyor;

whereby the shuttle means carries said forward-most sheet past the first and second blocking means to said additional conveyor, but a double sheet following said shuttle means past said first blocking member is stripped from said forward-most sheet and not allowed to follow said forward-most sheet to said additional conveyor by said second blocking means;

wherein is further included an endless clamp conveyor having clamps thereon for receiving sheets from said additional conveyor, said sheet-feeding system further comprising a sheet feeding transition tray having a continuously driven endless belt conveyor forming a nip with an idler roller which is biased toward said endless belt conveyor for conveying sheets received from said additional conveyor to said clamps positioned on said endless clamp conveyor, said sheet feeding transition tray including an idler-roller mounting means for allowing the position of said idler roller to be adjusted along the endless belt so that the position of said idler roller can be placed approximately a distance from a clamp receiving a sheet equal to the length of the sheet.

14. A sheet feeding device for feeding a forward-most sheet from a stack of flat sheets, said device comprising:

a hopper for holding said stack of sheets;

a movable shuttle means having a sheet-engaging surface on which said stack rests for gripping said forward-most sheet and pulling said forward-most sheet out of the sheet stack, said movable shuttle means having a motion in a separating direction substantially parallel to a plane of said flat sheets, said movable shuttle means defining a vacuum opening therethrough to said sheet-engaging surface;

a suction means for synchronously applying suction to said sheet-engaging surface through said vacuum opening for gripping said forward-most sheet to said sheet-engaging surface so that the shuttle means carries said forward-most sheet with it when it moves in said separating direction to deliver said forward-most sheet to an additional conveyor;

said additional conveyor being positioned downstream from said stack of flat sheets in said sheet-separating direction for receiving said forward-most sheet from said shuttle means and further pulling said sheet from said stack;

a first blocking means positioned adjacent said stack of said flat sheets and being spaced adjacent a path of said shuttle means in said separating direction downstream of said stack of flat sheets but upstream of said additional conveyor for contacting non-fed sheets in said stack other than said forward-most sheet and thereby preventing said non-fed sheets from following said forward-most sheet when it is fed in said separating direction;

a second blocking means positioned in said separating direction downstream of said first blocking means but upstream of said additional conveyor for contacting a double sheet, that is a sheet other than said forward-most sheet carried by said shuttle means in said separating direction, thereby preventing said double sheet from being fed to said additional conveyor;

whereby the shuttle means carries said forward-most sheet past the first and second blocking means to said additional conveyor, but a double sheet following said shuttle means past said first blocking member is stripped from said forward-most sheet and not allowed to follow said forward-most sheet to said additional conveyor by said second blocking means;

wherein is further included an adjusting means for allowing the position of said vacuum opening relative to said sheet stack in said hopper to be changed in a direction perpendicular to said separating direction approximately parallel to a plane of said forward-most sheet.

15. A sheet feeding device for feeding a forward-most sheet from a stack of flat sheets, said device comprising:

a hopper for holding said stack of sheets;

a movable shuttle means having a sheet-engaging surface on which said stack rests for gripping said forward-most sheet and pulling said forward-most sheet out of the sheet stack, said movable shuttle means having a motion in a separating direction substantially parallel to a plane of said flat sheets, said movable shuttle means defining a vacuum opening therethrough to said sheet-engaging surface;

a suction means for synchronously applying suction to said sheet-engaging surface through said vacuum opening for gripping said forward-most sheet to said sheet-engaging surface so that the shuttle means carries said forward-most sheet with it when it moves in said separating direction to deliver said forward-most sheet to an additional conveyor;

said additional conveyor being positioned downstream from said stack of flat sheets in said sheet-separating direction for receiving said forward-most sheet from said shuttle means and further pulling said sheet from said stack;

a first blocking means positioned adjacent said stack of said flat sheets and being spaced adjacent a path of said shuttle means in said separating direction downstream of said stack of flat sheets but upstream of said additional conveyor for contacting non-fed sheets in said stack other than said forward-most sheet and thereby preventing said non-fed sheets from following said forward-most sheet when it is fed in said separating direction;

a second blocking means positioned in said separating direction downstream of said first blocking means but upstream of said additional conveyor for contacting a double sheet, that is a sheet other than said forward-most sheet carried by said shuttle means in said separating direction, thereby preventing said double sheet from being fed to said additional conveyor;

whereby the shuttle means carries said forward-most sheet past the first and second blocking means to said additional conveyor, but a double sheet following said shuttle means past said first blocking member is stripped from said forward-most sheet and not allowed to follow said forward-most sheet to said additional conveyor by said second blocking means;

wherein said shuttle means includes a vacuum panel at said vacuum opening having surfaces above adjacent surfaces for contacting said forward-most sheet.

* * * * *